US008957825B2

(12) United States Patent
Chen et al.

(10) Patent No.: US 8,957,825 B2
(45) Date of Patent: Feb. 17, 2015

(54) DECOUPLING CIRCUIT AND ANTENNA DEVICE

(71) Applicant: Wistron NeWeb Corporation, Hsinchu (TW)

(72) Inventors: I-Shan Chen, Hsinchu (TW); Chao-Chun Lin, Hsinchu (TW); Yi-Chieh Wang, Hsinchu (TW); Cheng-Hsiung Hsu, Hsinchu (TW)

(73) Assignee: Wistron NeWeb Corporation, Hsinchu (TW)

( * ) Notice: Subject to any disclaimer, the term of this patent is extended or adjusted under 35 U.S.C. 154(b) by 201 days.

(21) Appl. No.: 13/789,613

(22) Filed: Mar. 7, 2013

(65) Prior Publication Data

US 2014/0125543 A1 May 8, 2014

(30) Foreign Application Priority Data

Nov. 6, 2012 (TW) ..... 101141134 A

(51) Int. Cl.

| | |
|---|---|
| ***H01Q 21/28*** | (2006.01) |
| ***H01Q 1/32*** | (2006.01) |
| ***H01Q 1/42*** | (2006.01) |
| ***H01Q 1/52*** | (2006.01) |
| ***H01Q 9/42*** | (2006.01) |

(52) U.S. Cl.

CPC ..... *H01Q 21/28* (2013.01); *H01Q 1/3275* (2013.01); *H01Q 1/42* (2013.01); *H01Q 1/521* (2013.01); *H01Q 9/42* (2013.01)

USPC ..... 343/841; 343/700 MS

(58) Field of Classification Search

CPC ..... H01Q 1/3275; H01Q 1/42; H01Q 21/28; H01Q 9/42; H01Q 1/521

USPC ..... 343/841, 702, 700 MS

See application file for complete search history.

(56) References Cited

U.S. PATENT DOCUMENTS

| | | | | |
|---|---|---|---|---|
| 8,836,588 | B2 * | 9/2014 | Hayashi et al. | 343/702 |
| 2004/0051669 | A1 * | 3/2004 | Rutfors et al. | 343/702 |
| 2007/0164920 | A1 * | 7/2007 | Chen | 343/795 |
| 2008/0258992 | A1 * | 10/2008 | Tsai et al. | 343/853 |
| 2009/0027286 | A1 * | 1/2009 | Ohishi et al. | 343/750 |

* cited by examiner

*Primary Examiner* — Hoanganh Le

(74) *Attorney, Agent, or Firm* — Winston Hsu; Scott Margo

(57) ABSTRACT

A decoupling circuit for enhancing isolation of two antennas is disclosed. The two antennas are substantially symmetrically disposed on a substrate. The decoupling circuit includes a first and second metal strips parallel disposed between the two antennas and electrically connected to a ground, a connection strip electrically connected between terminals of the first and second metal strips, to substantially form a door-frame structure, a first comb structure comprising a plurality of metal segments parallel to each other, disposed on the substrate, electrically connected to and perpendicular to the first metal strip, and a second comb structure comprising a plurality of metal segments parallel to each other, disposed on the substrate, electrically connected to and perpendicular to the second metal strip.

20 Claims, 13 Drawing Sheets

DECOUPLING CIRCUIT AND ANTENNA DEVICE

BACKGROUND OF THE INVENTION

1. Field of the Invention

The present invention is related to a decoupling circuit and an antenna device, more particularly, to a decoupling circuit and an antenna device capable of reducing coupling effect between antennas, to enhance antenna isolation.

2. Description of the Prior Art

Electronic products with wireless communication functionalities utilize antennas to emit and receive radio waves, to transmit or exchange radio signals, so as to access a wireless communication network. Therefore, to facilitate a user's access to the wireless communication network, an ideal antenna should maximize its bandwidth within a permitted range, while minimizing physical dimensions to accommodate the trend for smaller-sized electronic products. Additionally, with the advance of wireless communication technology, electronic products may be configured with an increasing number of antennas. For example, a long term evolution (LTE) wireless communication system and a wireless local area network standard IEEE 802.11n both support multi-input multi-output (MIMO) technology, i.e. an electronic product is capable of concurrently receiving and transmitting wireless signals via multiple (or multiple sets of) antennas, to vastly increase system throughput and transmission distance without increasing system bandwidth or total transmission power expenditure, thereby effectively enhancing spectral efficiency and transmission rate for the wireless communication system, as well as improving communication quality.

As can be seen, a prerequisite for implementing spatial multiplexing and spatial diversity in MIMO is to employ multiple sets of antenna to divide a space into many channels, in order to provide multiple antenna field patterns. When an electronic product is configured with multiple sets of antenna under a limited space, a basic requirement includes that these antennas are independent, do not affect each other, and have good isolation. Therefore, how to reduce mutual coupling between antennas becomes one of the industry goals. However, in the limited space, to enhance the isolation of the antennas and simultaneously maintain throughput of MIMO must increase design complexity. Therefore, it is a common goal in the industry to design antennas that suit both transmission demands, as well as dimension and functionality requirements.

SUMMARY OF THE INVENTION

It is therefore an objective of the present invention to provide a decoupling circuit and an antenna device capable of reducing coupling effect between antennas, to enhance antennas isolation.

The present invention discloses a decoupling circuit for enhancing isolation of two antennas substantially symmetrically disposed on a substrate. The decoupling circuit comprises a first metal strip, disposed between the two antennas on the substrate, and electrically connected to a ground; a second metal strip, disposed between the two antennas on the substrate, substantially parallel to the first metal strip, and electrically connected to the ground; a metal connection strip, disposed between the two antennas on the substrate, and electrically connected to a terminal of the first metal strip and a terminal of the second metal strip, to substantially form a doorframe structure with the first metal strip and the second metal strip; a first comb structure, comprising a plurality of metal segments parallel to each other, disposed on the substrate, and electrically connected to and perpendicular to the first metal strip; and a second comb structure, comprising a plurality of metal segments parallel to each other, disposed on the substrate, and electrically connected to and perpendicular to the second metal strip.

The present invention further discloses an antenna device. The antenna device comprises a substrate; two antennas, substantially symmetrically disposed on the substrate; and a decoupling circuit, comprising: a first metal strip, disposed between the two antennas on the substrate, and electrically connected to a ground; a second metal strip, disposed between the two antennas on the substrate, substantially parallel to the first metal strip, and electrically connected to the ground; a metal connection strip, disposed between the two antennas on the substrate, and electrically connected to a terminal of the first metal strip and a terminal of the second metal strip, to substantially form a doorframe structure with the first metal strip and the second metal strip; a first comb structure, comprising a plurality of metal segments parallel to each other, disposed on the substrate, and electrically connected to and perpendicular to the first metal strip; and a second comb structure, comprising a plurality of metal segments parallel to each other, disposed on the substrate, and electrically connected to and perpendicular to the second metal strip.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
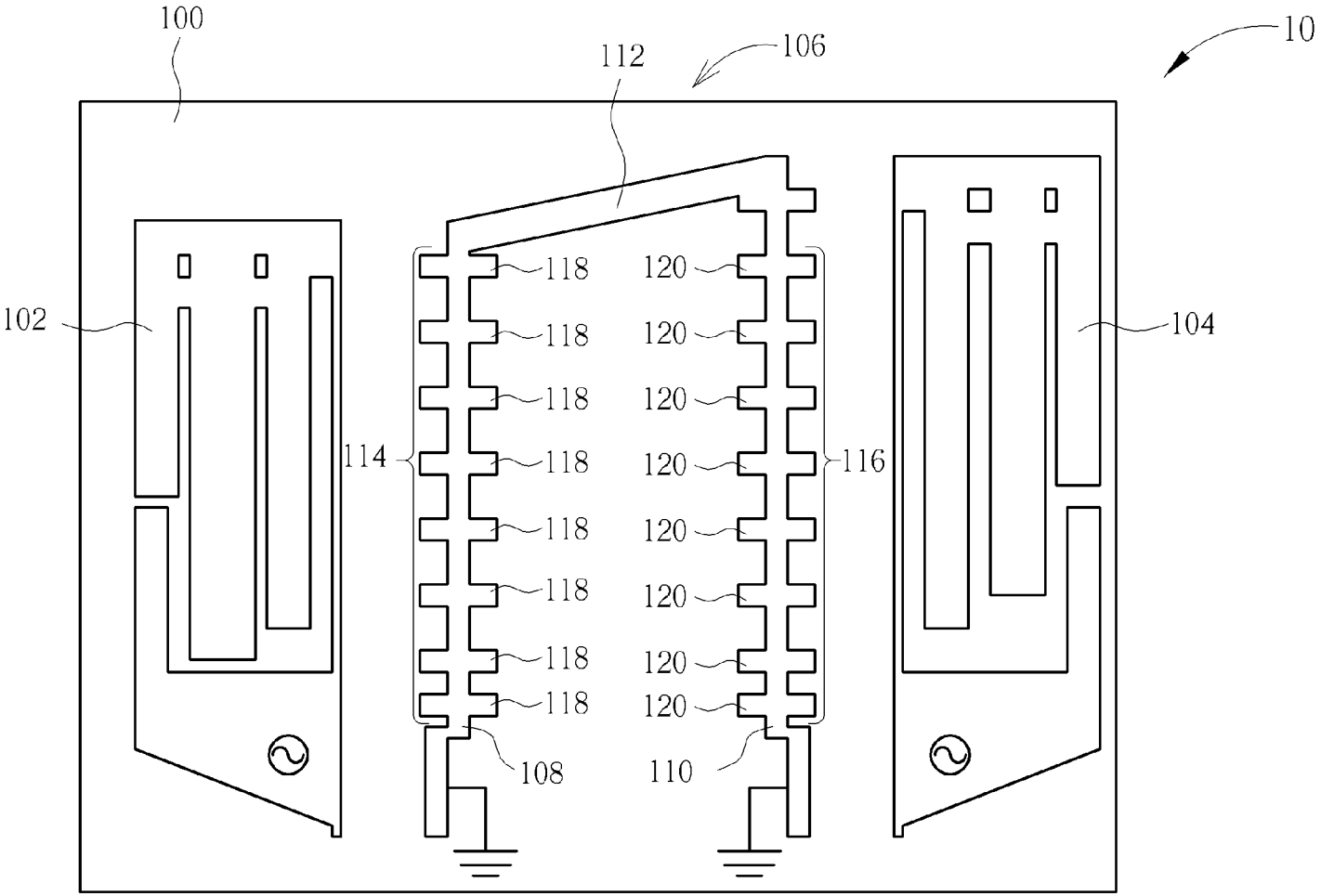
FIG. 1 illustrates a schematic diagram of an antenna device according to an embodiment of the present invention.

Please refer to FIG. 1, which illustrates a schematic diagram of an antenna device 10 according to an embodiment of the present invention. The antenna device 10 comprises a substrate 100, a first antenna 102, a second antenna 104 and a decoupling circuit 106. The substrate 100 may be a printed circuit board or a part of a housing of an electronic device. If the substrate 100 is the housing of the electronic device, the substrate 100 may include structures of corrugations/protrusions/holes for matching external design of mechanism or may have flexibility. However, to simply and clearly illustrate the concept of the present invention, it is assumed that the substrate 100 is flat. The first antenna 102 and the second antenna 104 are both monopole antennas, substantially symmetrical, and disposed on the substrate 100. The decoupling circuit 106 is made of conducting materials, and disposed between the first antenna 102 and the second antenna 104 on the substrate 100 for reducing coupling effect between the first antenna 102 and the second antenna 104, to enhance antenna isolation, such that a throughput of multi-input or multi-output (MIMO) can be maintained or increased.

In detail, the decoupling circuit 106 comprises a first metal strip 108, a second metal strip 110, a metal connection strip 112, a first comb structure 114 and a second comb structure 116. The first metal strip 108 and the second metal strip 110 are parallel, disposed on the substrate 100, and electrically connected to a ground. The metal connection strip 112 is disposed on the substrate 100, and electrically connected to the first metal strip 108 and a top of the second metal strip 110, to substantially form a doorframe structure with the first metal strip 108 and the second metal strip 110 (i.e. similar to a "π" shape), wherein a distance between the first metal strip 108 and the first antenna 102 is substantially equal to a quarter of a wavelength of wireless signals. In the same way, a distance between the second metal strip 110 and the second antenna 104 is also equal to a quarter of the wavelength of the wireless signals. On the other hand, the first comb structure 114 is composed of multiple metal segments 118 parallel to each other. The metal segments 118 are disposed on the substrate 100, and electrically connected to the first metal strip 110, wherein a distance between any two of juxtaposed metal segments 118 is between one-twentieth and one-tenth of the wavelength of the wireless signals. In the same way, the second comb structure 116 comprises multiple metal segments 120 parallel to each other. The metal segments 120 are disposed on the substrate 100 and electrically connected to the second metal strip 112. A distance between any two of juxtaposed metal segments 120 is between one-twentieth and one-tenth of the wavelength of the wireless signals. In addition, the metal segments 118, 120 are respectively parallel to the first metal strip 110 and the second metal strip 112. More specifically, the metal segments 118, 120 are orthogonal to a direction of vertical polarization of antennas.

Therefore, since the first metal strip 108, the second metal strip 110, and the metal connection strip 112 form the doorframe structure which is on the same plane of the first antenna 102 and the second antenna 104 and also between the first antenna 102 and the second antenna 104, coupling effect is effectively blocked by space. Simultaneously, the metal segments 118, 120 effectively avoid transmission of direct waves of corresponding frequency bands. Under such a situation, concerning frequency bands of LTE, a width covering the first antenna 102 and the second antenna 104 is less than 4 centimeters, such that spectral efficiency can be enhanced effectively.

Note that, FIG. 1 is an embodiment of the present invention. Those skilled in the art should make modifications or alterations accordingly. For example, please refer to FIG. 2, which illustrates a schematic diagram of an antenna device 20 according to an embodiment of the present invention. Structures and operations of the antenna device 20 and the antenna device 10 in FIG. 1 are similar. Thus, the same components are presented by the same symbols for simplicity. A difference between the antenna device 20 and the antenna device 10 is that a decoupling circuit 206 of the antenna device 20 further comprises a third metal strip 200 and a fourth metal strip 202 in comparison with the decoupling circuit 106. The antenna device 20 can also reduce coupling effect between antennas, to enhance isolation. In detail, the third metal strip 200 is disposed between the first metal strip 108 and the first antenna 102, and electrically connected to the ground. The fourth metal strip 202 is disposed between the second metal strip 110 and the second antenna 104, and also electrically connected to the ground. The third metal strip 200 and the fourth metal strip 202 can adjust a bandwidth to raise flexibility of design.

Figure 3:
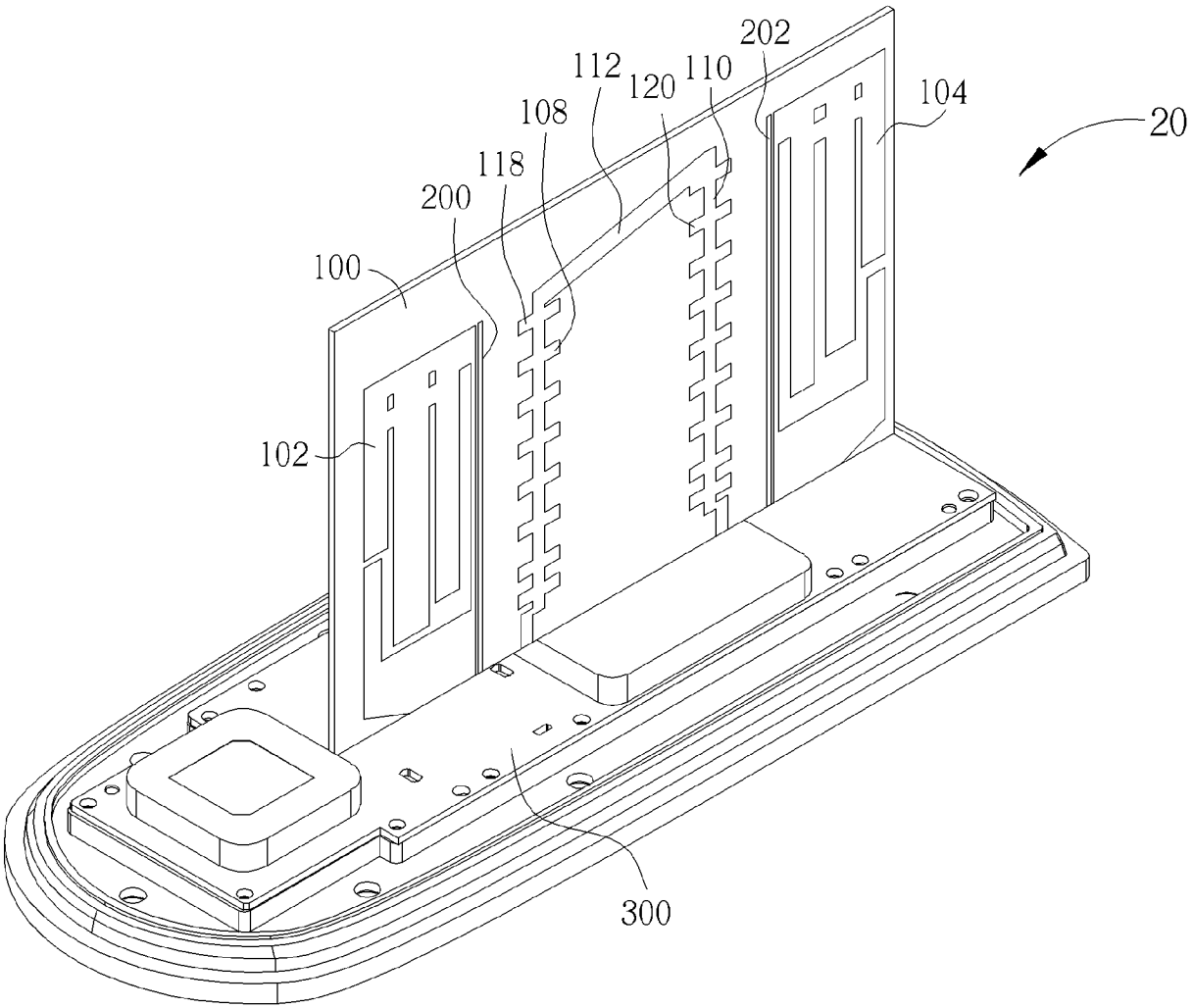
FIG. 3 illustrates a schematic diagram of the antenna device in FIG. 2 disposed vertically on a base.

Besides, as mentioned above, the substrate 100 can be a printed circuit board. Under such a situation, the antenna devices 10, 20 can be disposed on a base vertically. For example, FIG. 3 illustrates a schematic diagram of the antenna device 20 disposed vertically on a base 300. In FIG. 3, depending on different applications, the base 300 may comprise mechanism for fixing the antenna device 20, radio frequency circuits for processing radio signals, processors, etc.

Figure 2:
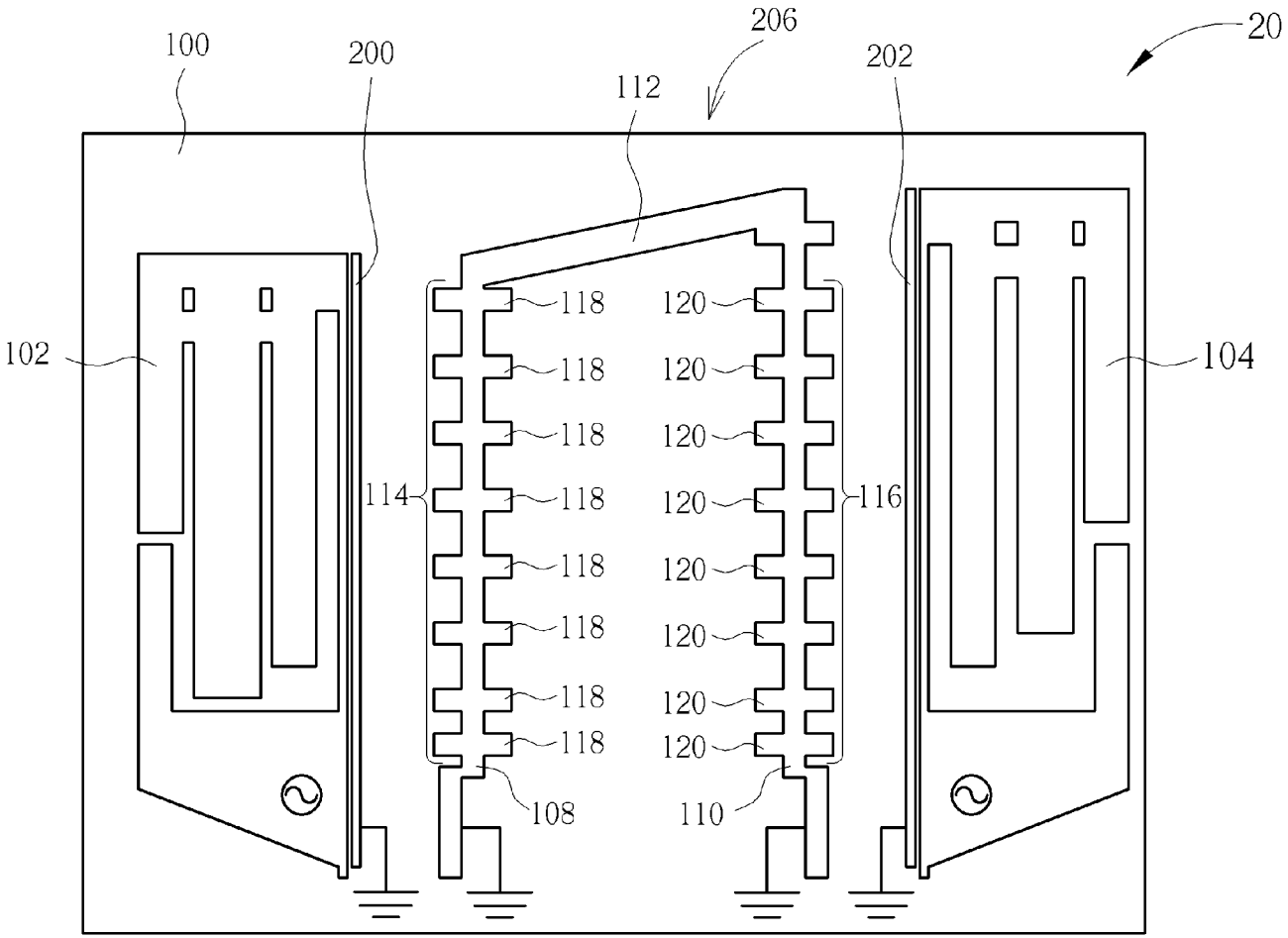
FIG. 2 illustrates a schematic diagram of an antenna device according to an embodiment of the present invention.
Figure 4:
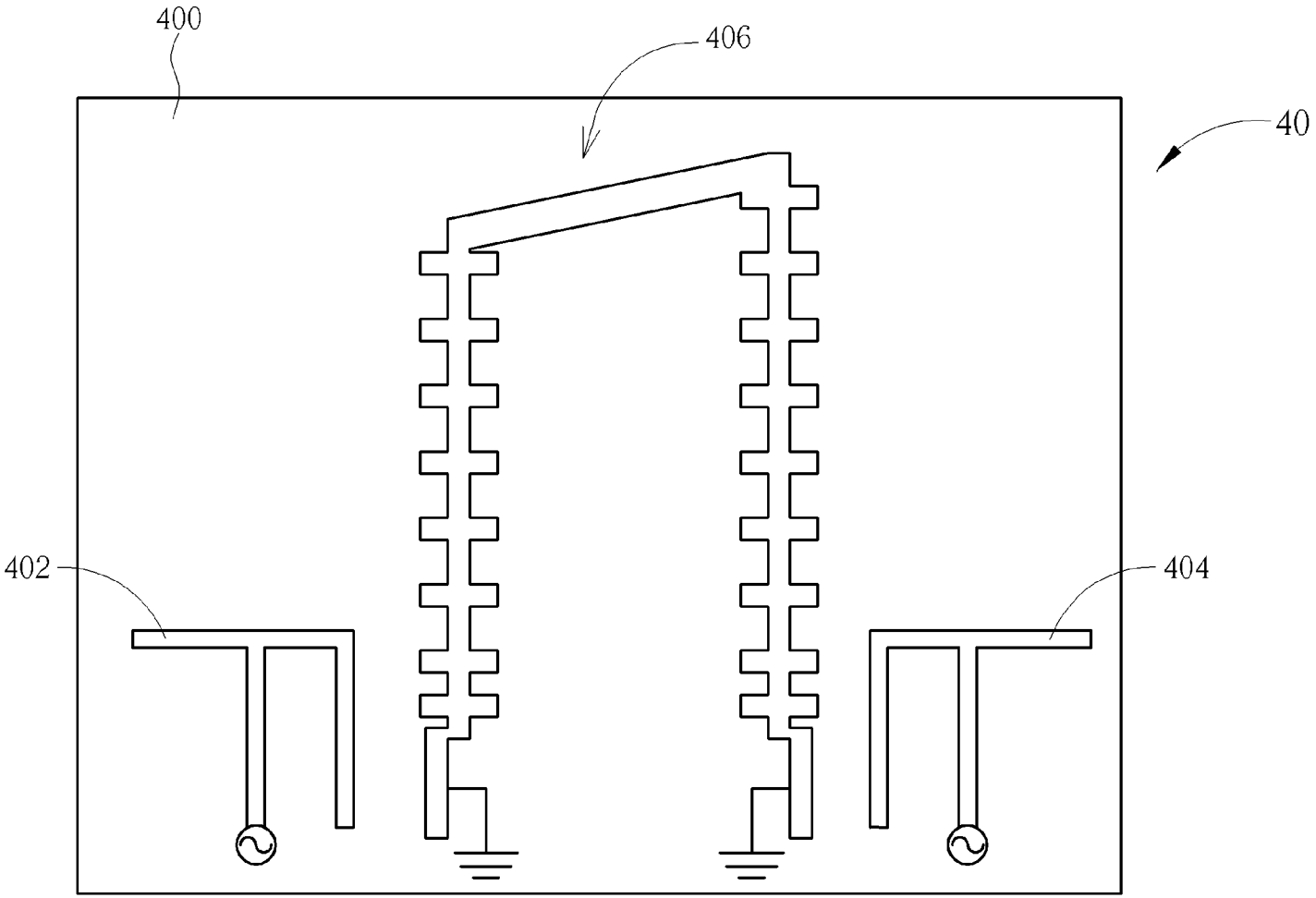
FIG. 4 illustrates a schematic diagram of an antenna device according to an embodiment of the present invention.
Figure 5:
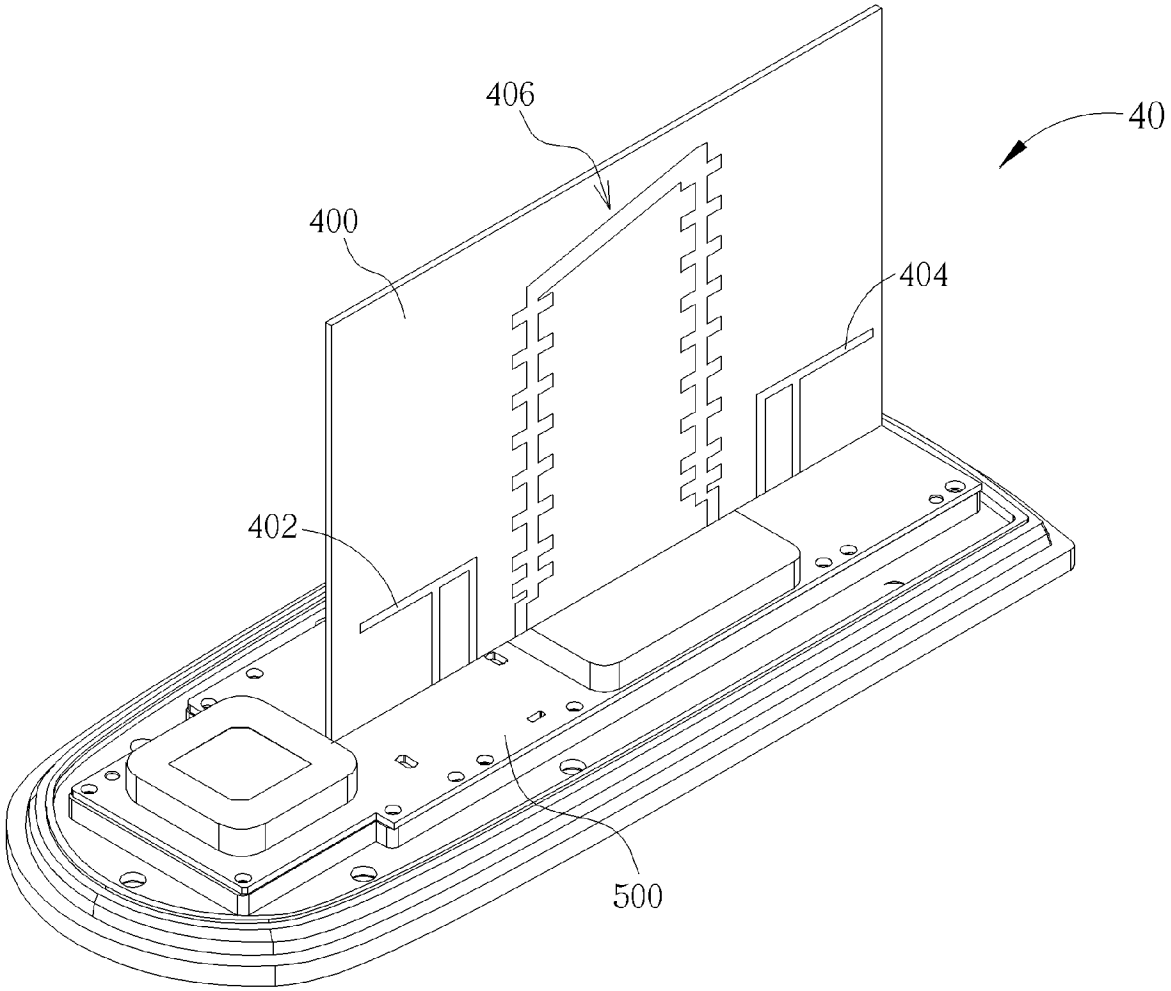
FIG. 5 illustrates a schematic diagram of the antenna device in FIG. 4 disposed vertically on a base.

On the other hand, in FIG. 1 or FIG. 2, lengths of the first metal strip 108 and the second metal strip 110 can be either different or the same depending on system requirements. In the same way, lengths of the third metal strip 200 and the fourth metal strip 202 can also be either different or the same. Besides, in FIG. 1 or FIG. 2, the first antenna 102 and the second antenna 104 are substantially parallel, and both formed by three monopole antennas with doorframe structures which can generate capacitor effect, to shorten lengths of antennas effectively. One of the monopole antenna structures is shorter than a quarter of a corresponding wavelength of the wireless signals. In addition, shapes or sizes of the first antenna 102 and the second antenna 104 can be adjusted according to system requirements, or other forms of antennas can be adopted. For example, please refer to FIG. 4, which illustrates a schematic diagram of an antenna device 40 according to an embodiment of the present invention. Structures and operations of the antenna device 40 and the antenna device 10 in FIG. 1 are similar. The antenna device 40 comprises a substrate 400, a first antenna 402, a second antenna 404 and a decoupling circuit 406. Structures and operations of the decoupling circuit 406 and the decoupling circuit 106 in FIG. 1 are the same, and both are utilized for reducing coupling effect between antennas, to enhance antenna isolation, such that the throughput of MIMO can be maintained or increased. A difference between the antenna device 40 and the antenna device 10 is that the first antenna 402 and the second antenna 404 of the antenna device 40 form a planar inverted F antenna, which is also within the scope of the present invention. Certainly, the antenna device 40 may also add third and fourth medal strips such as the antenna device 20 shown in FIG. 2, or may be disposed on a base 500 as shown in FIG. 5.

Figure 6:
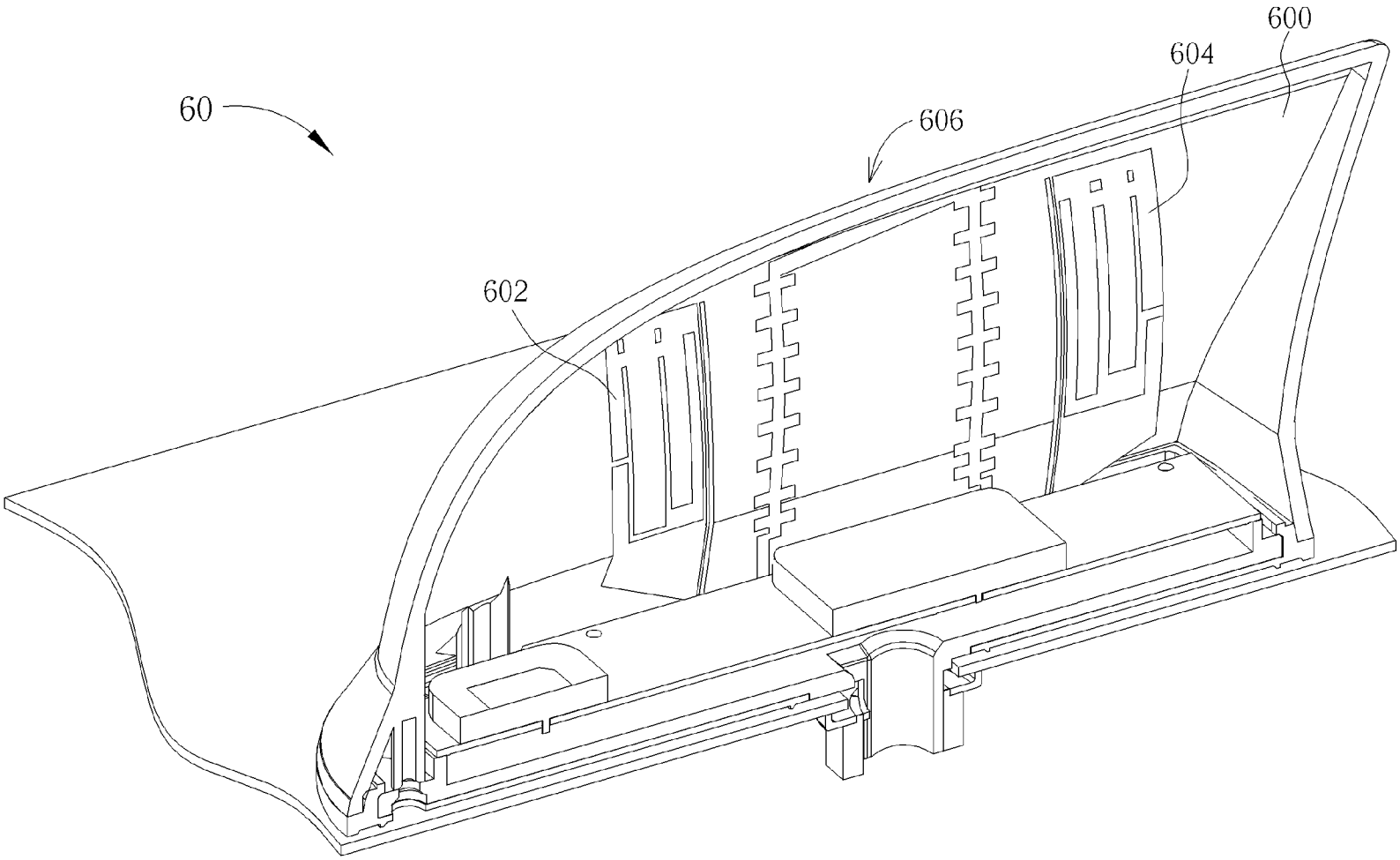
FIG. 6 illustrates a sectional-view diagram of an antenna device according to an embodiment of the present invention.

In the above-mentioned embodiments, the substrates 100, 400 are flat structures as examples. However, as mentioned above, the substrate 100 may be a part of a housing of an electronic device, and may include structures of corrugations/protrusions/holes for matching external design. Under such a situation, the decoupling circuit of the present invention can also reduce coupling effect between antennas and enhance antenna isolation. For example, please refer to FIG. 6, which illustrates a sectional-view diagram of an antenna device 60 according to an embodiment of the present invention. The antenna device 60 comprises a substrate 600, a first antenna 602, a second antenna 604, and a decoupling circuit 606. As can be seen by comparing the antenna device 60 in FIG. 6 and the antenna device 20 in FIG. 2 or FIG. 3, structures of the antenna device 60 and the antenna device 20 are similar and thus the antenna device 60 can also reduce coupling effect between antennas by the decoupling circuit 606, to enhance antenna isolation, such that the throughput of MIMO can be maintained or increased. A difference between the antenna device 60 and the antenna device 20 is that the substrate 600 is a part of a housing of a top antenna on a car. In other words, the first antenna 602, the second antenna 604, and the decoupling circuit 606 are disposed or directly formed inside the housing of the top antenna on the car by means of laser direct structuring (LDS), or using a conductive coating material to coat, print, perform evaporation deposition, or produce on the surface of the housing of the product before coating or rubber coating to cut off from contact, etc., but are not limited to this.

Figure 7A:
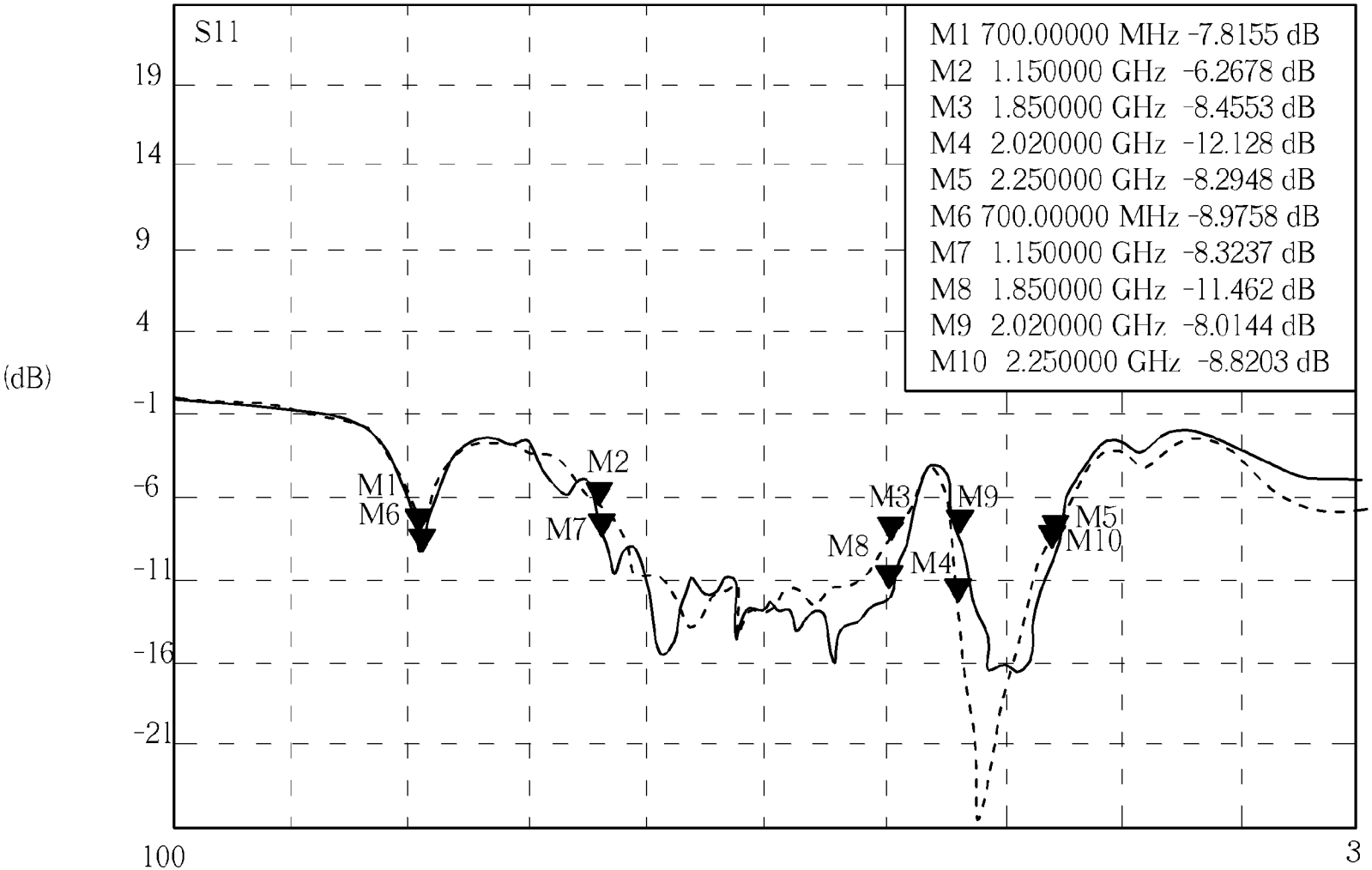
FIG. 7A, 7B are schematic diagrams of voltage standing wave ratio when the antenna device is applied to a LTE system for performing multi-input multi-output operation.
Figure 7B:
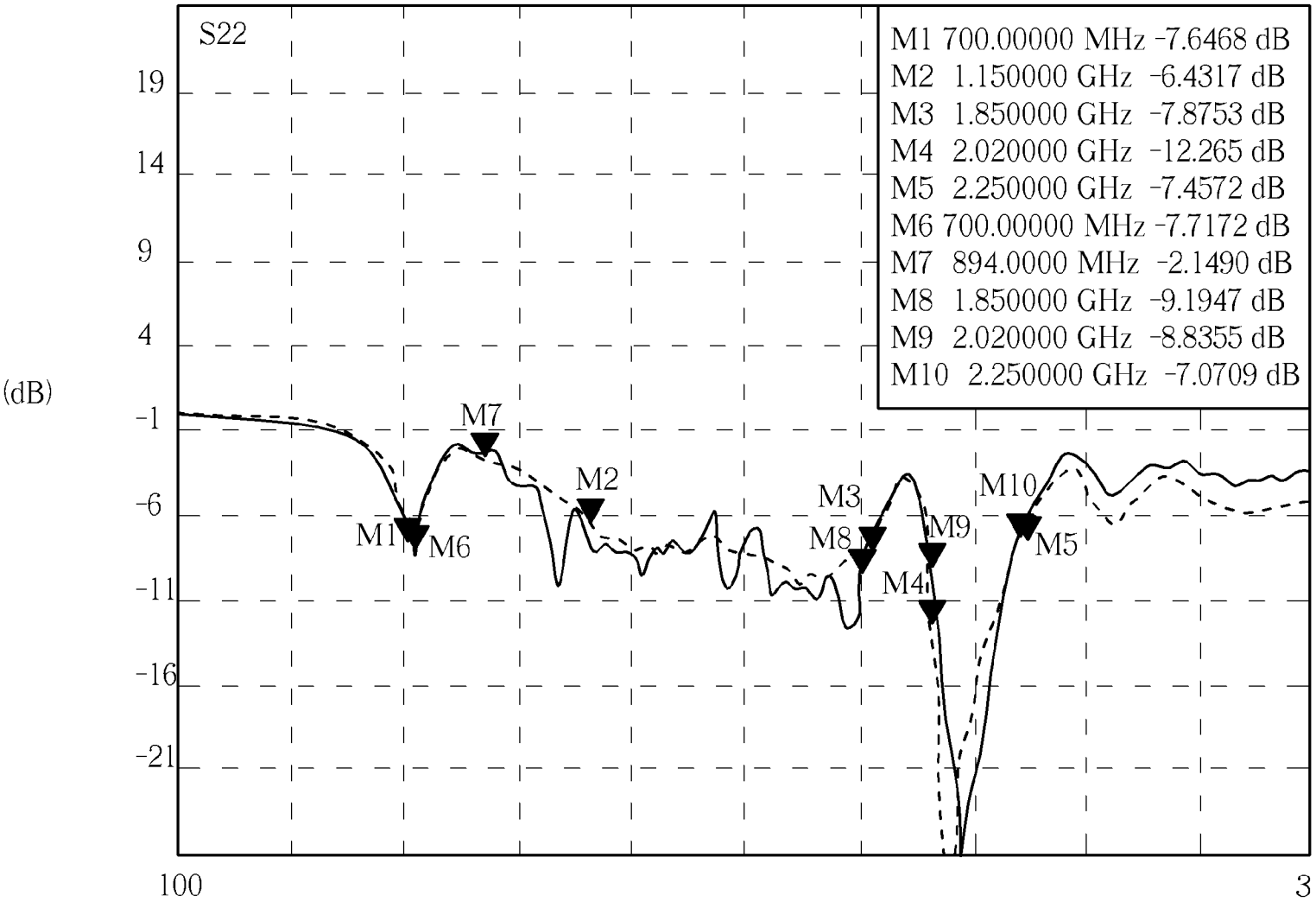
Figure 8:
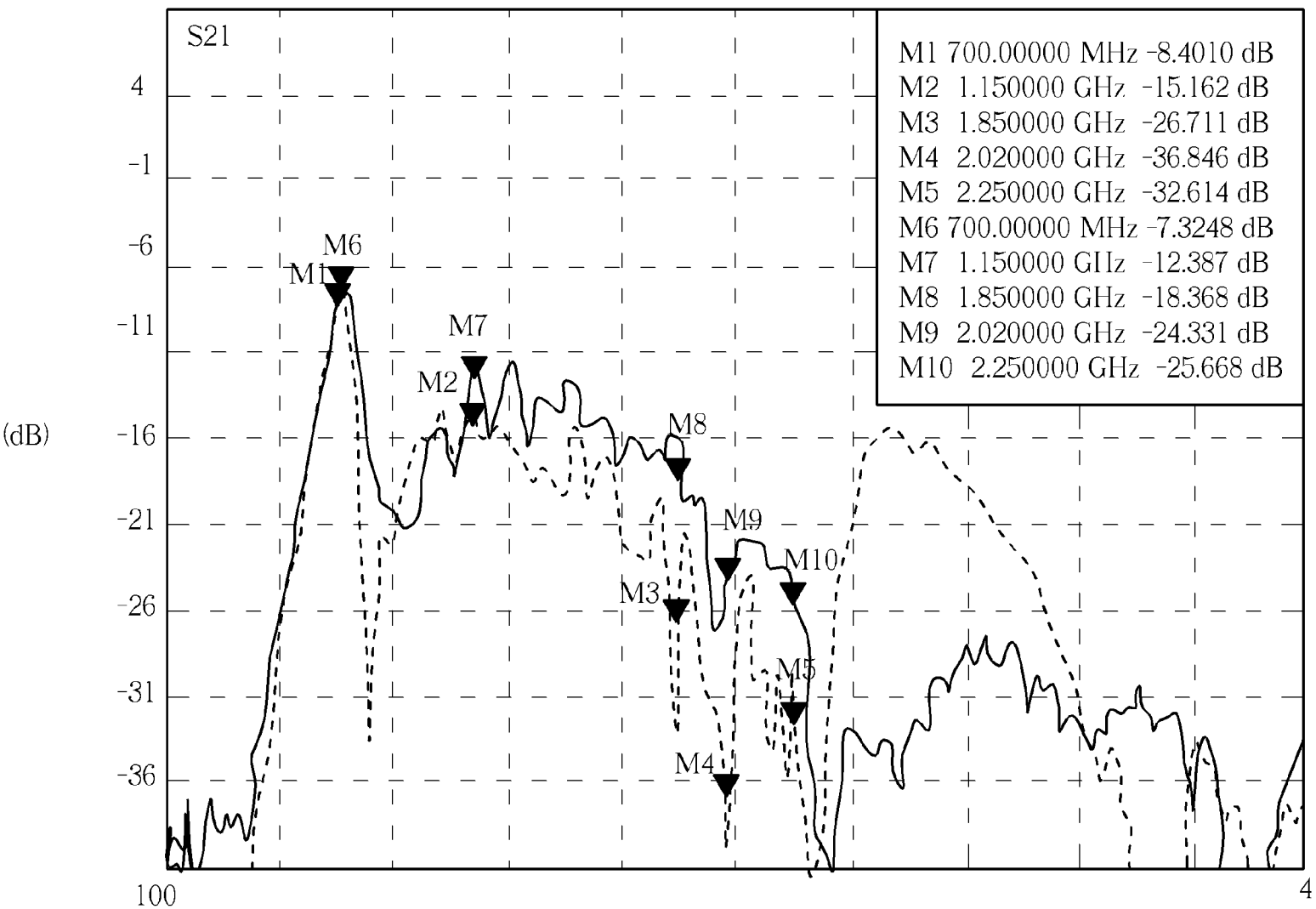
FIG. 8 is a schematic diagram of isolation when the antenna device in FIG. 6 is applied to a LTE system for performing multi-input multi-output operation.
Figure 9A:
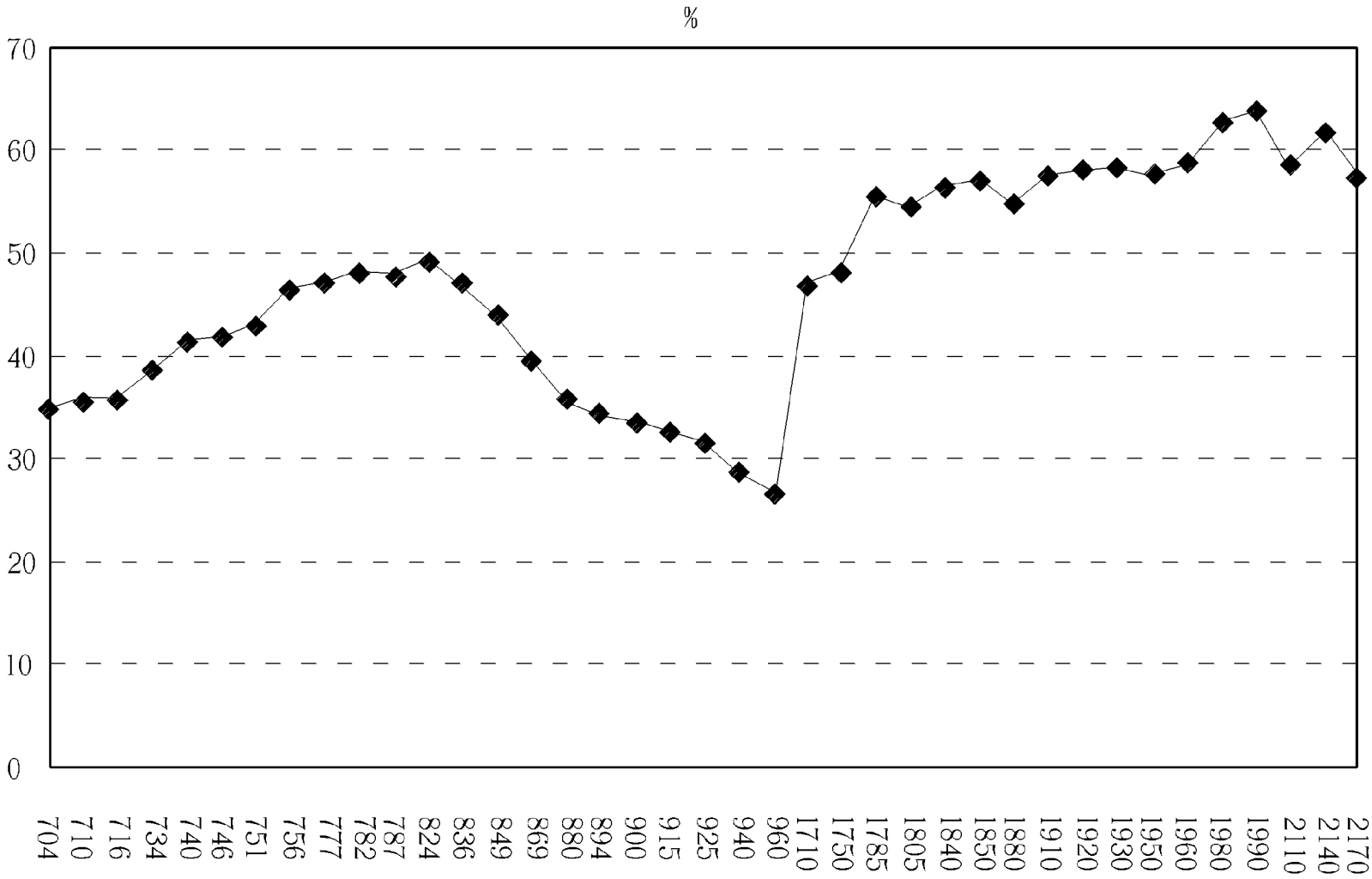
FIG. 9A, 9B are diagrams of radiation efficiency of a first antenna and a second antenna when the antenna device in FIG. 6 is applied to a LTE system for performing multi-input multi-output operation.
Figure 9B:
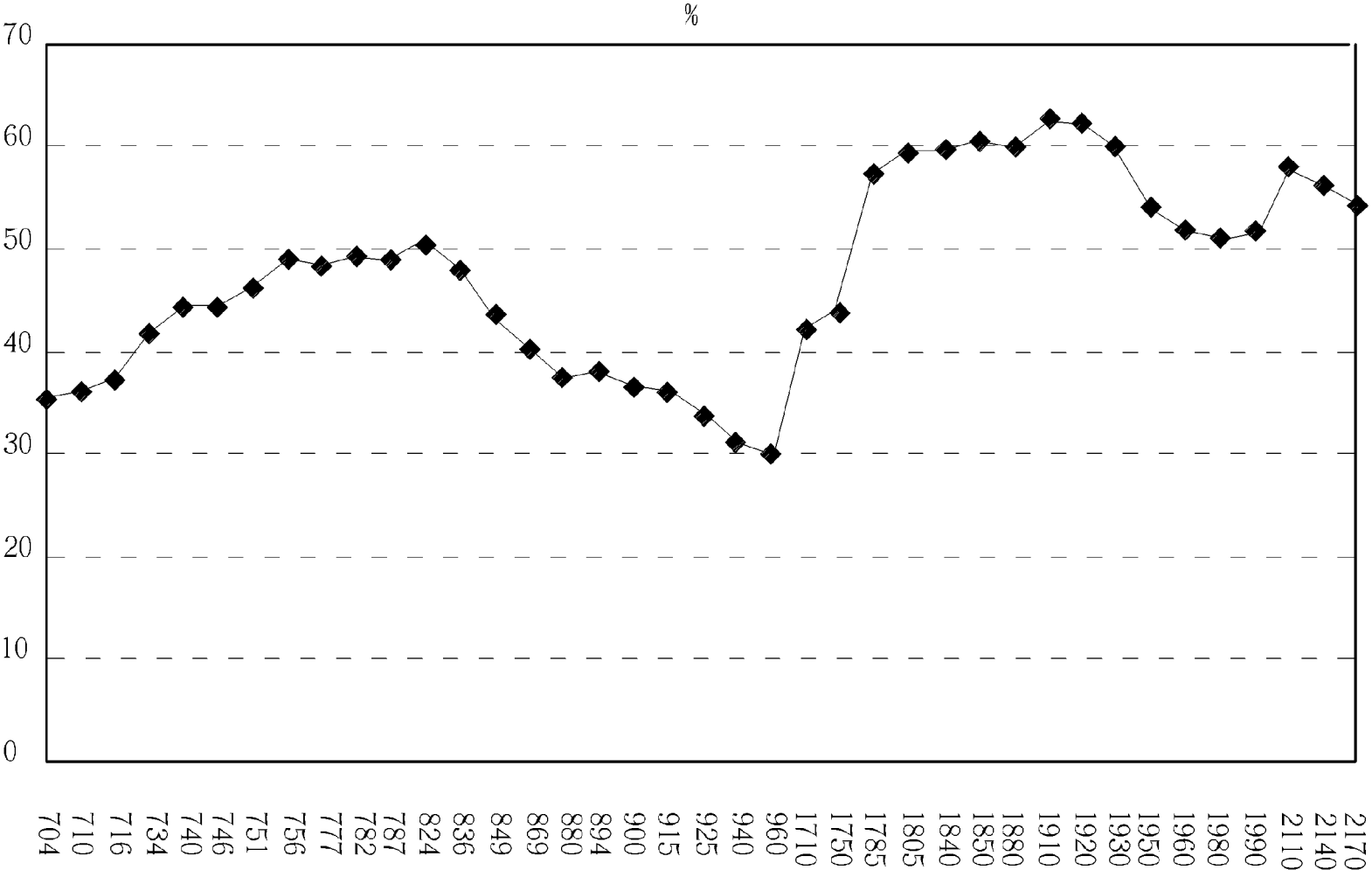
Figure 10A:
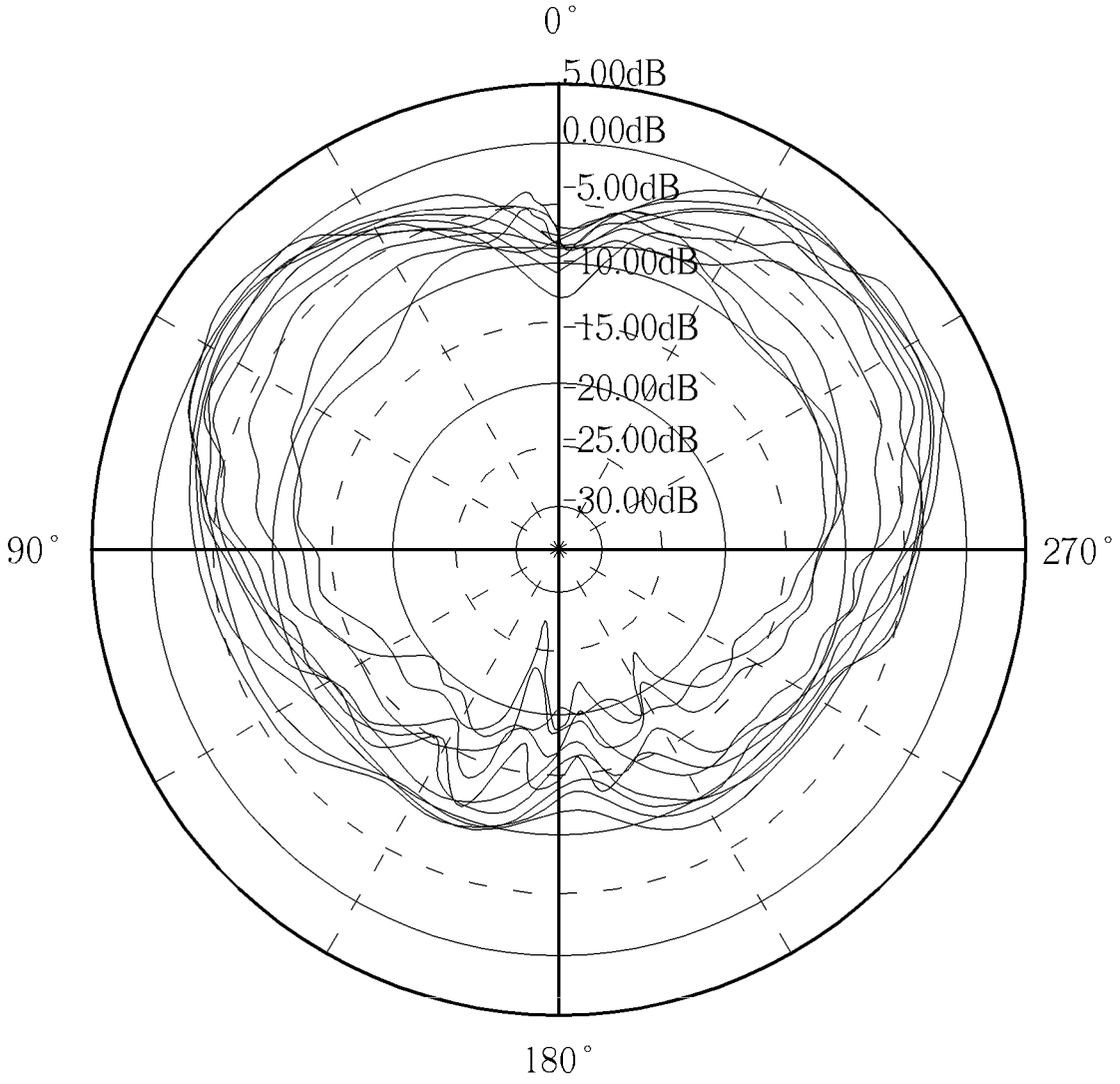
FIG. 10A, 10B are field diagrams of E-plane of a first antenna and a second antenna when the antenna device in FIG. 6 is applied to a LTE system for performing multi-input multi-output operation.
Figure 10B:
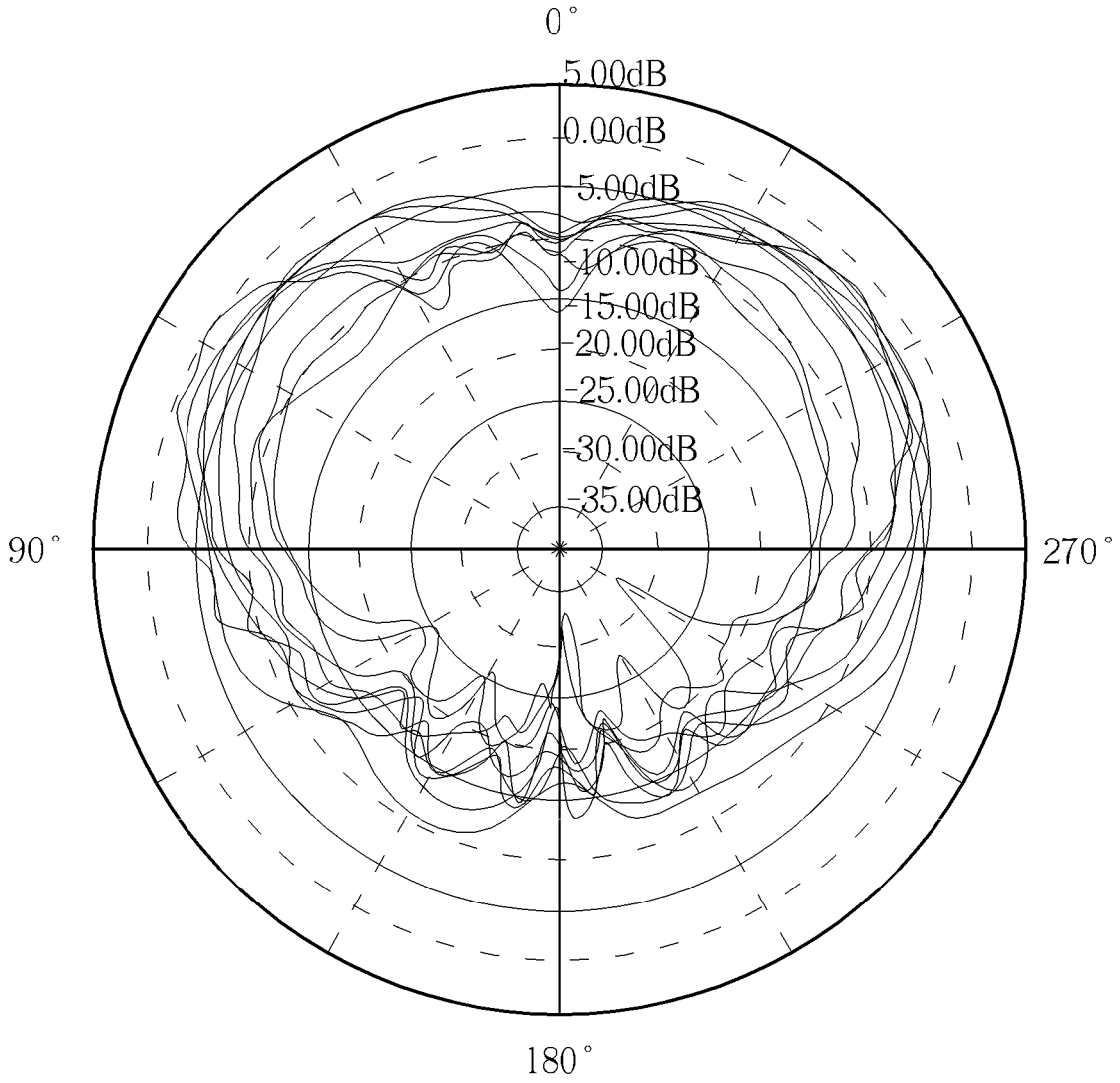

In addition, the size and material of the antenna device 60 can be adjusted according to different systems. When a LTE system is applied, a width covering the first antenna 602 and the second antenna 604 can be less than 4 centimeters, to enhance spectral efficiency effectively. In addition, when the antenna device 60 is applied to the LTE system, efficiency of multi-input multi-output can further refer to FIGS. 7A, 7B, 8, 9A, 9B, 10A and 10B. FIG. 7A, 7B are schematic diagrams of voltage standing wave ratio when the antenna device 60 is applied to the LTE system for performing multi-input multi-output operation (i.e. S11, S22 parameters). FIG. 8 is a schematic diagram of isolation when the antenna device 60 is applied to the LTE system for performing multi-input multi-output operation (i.e. S21 parameter). In FIG. 7A, 7B, 8, dashed lines and solid lines respectively illustrate results of testing or simulation of the first antenna 602 and the second antenna 604. As can be seen, the isolation of the antenna device 60 can be 20-35 dB within the frequency band 2.02-2.25 GHz. In addition, FIG. 9A, 9B are diagrams of radiation efficiency of the first antenna 602 and the second antenna 604 when the antenna device 60 is applied to the LTE system for performing multi-input multi-output operation. FIG. 10A, 10B are field diagrams of E-plane of the first antenna 602 and the second antenna 604 when the antenna device 60 is applied to the LTE system for performing multi-input multi-output operation. Therefore, as can be seen in FIG. 7A, 7B to FIG. 10A, 10B, even in a limited space, the antenna device 60 still has appropriate bandwidth, and the isolation and the radiation efficiency of the antenna device 60 maintain well when the antenna device 60 performs multi-input multi-output operation.

To sum up, decoupling circuits of the present invention can effectively enhance the antenna isolation and spectral efficiency, and reduce coupling effect between antennas to enhance antenna isolation, such that the throughput of MIMO can be maintained or increased.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A decoupling circuit, for enhancing isolation of two antennas substantially symmetrically disposed on a substrate, the decoupling circuit comprising:

a first metal strip, disposed between the two antennas on the substrate, and electrically connected to a ground;

a second metal strip, disposed between the two antennas on the substrate, substantially parallel to the first metal strip, and electrically connected to the ground;

a metal connection strip, disposed between the two antennas on the substrate, and electrically connected to a terminal of the first metal strip and a terminal of the second metal strip, to substantially form a doorframe structure with the first metal strip and the second metal strip;

a first comb structure, comprising a plurality of metal segments parallel to each other, disposed on the substrate, and electrically connected to and perpendicular to the first metal strip; and a second comb structure, comprising a plurality of metal segments parallel to each other, disposed on the substrate, and electrically connected to and perpendicular to the second metal strip.

2. The decoupling circuit of claim 1, wherein the two antennas are separated by a first distance, the first metal strip and an antenna near to the first metal strip within the two antennas are separated by a second distance, the second metal strip and an antenna near to the second metal strip within the two antennas are separated by a third distance, and the first distance is greater than a sum of the second distance and the third distance.

3. The decoupling circuit of claim 2, wherein the two antennas are utilized for transmitting and receiving wireless signals of a specific frequency band respectively, and the second distance or the third distance is substantially equal to a quarter of a wavelength of the wireless signals.

4. The decoupling circuit of claim 3, wherein a distance between any two of adjacent metal segments in the first comb structure and the second comb structure is between the one-twentieth and one-tenth of the wavelength of the wireless signals.

5. The decoupling circuit of claim 1, wherein a length of the first metal strip is smaller than a length of the second metal strip.

6. The decoupling circuit of claim 1, further comprising:

a third metal strip, disposed between the first metal strip and an antenna of the two antennas outside the doorframe structure, and electrically connected to the ground; and a fourth metal strip, disposed between the second metal strip and another antenna of the two antennas outside the doorframe structure, and electrically connected to the ground.

7. The decoupling circuit of claim 1, wherein the substrate is a part of a housing of an electronic device.

8. The decoupling circuit of claim 1, wherein the substrate comprises at least one protrusion.

9. The decoupling circuit of claim 1, being disposed on the substrate by means of laser direct structuring.

10. The decoupling circuit of claim 1, wherein the two antennas are both planar monopole antennas.

11. An antenna device, comprising:

a substrate;

two antennas, substantially symmetrically disposed on the substrate; and a decoupling circuit, comprising:

a first metal strip, disposed between the two antennas on the substrate, and electrically connected to a ground;

a second metal strip, disposed between the two antennas on the substrate, substantially parallel to the first metal strip, and electrically connected to the ground;

a metal connection strip, disposed between the two antennas on the substrate, and electrically connected to a terminal of the first metal strip and a terminal of the second metal strip, to substantially form a doorframe structure with the first metal strip and the second metal strip;

a first comb structure, comprising a plurality of metal segments parallel to each other, disposed on the substrate, and electrically connected to and perpendicular to the first metal strip; and a second comb structure, comprising a plurality of metal segments parallel to each other, disposed on the substrate, and electrically connected to and perpendicular to the second metal strip.

12. The antenna device of claim 11, wherein the two antennas are separated by a first distance, the first metal strip and an antenna near to the first metal strip within the two antennas are separated by a second distance, the second metal strip and an antenna near to the second metal strip within the two antennas are separated by a third distance, and the first distance is greater than a sum of the second distance and the third distance.

13. The antenna device of claim 12, wherein the two antennas are utilized for transmitting and receiving wireless signals of a specific frequency band respectively, and the second distance or the third distance is substantially equal to a quarter of a wavelength of the wireless signals.

14. The antenna device of claim 13, wherein a distance between any two of adjacent metal segments in the first comb structure and the second comb structure is between the one-twentieth and one-tenth of the wavelength of the wireless signals.

15. The antenna device of claim 11, wherein a length of the first metal strip is smaller than a length of the second metal strip.

16. The antenna device of claim 11, wherein the decouple circuit further comprises:

a third metal strip, disposed between the first metal strip and an antenna of the two antennas outside the doorframe structure, and electrically connected to the ground; and a fourth metal strip, disposed between the second metal strip and another antenna of the two antennas outside the doorframe structure, and electrically connected to the ground.

17. The antenna device of claim 11, wherein the substrate is a part of a housing of an electronic device.

18. The antenna device of claim 11, wherein the substrate comprises at least one protrusion.

19. The antenna device of claim 18, wherein the decoupling circuit is disposed on the substrate by means of laser direct structuring.

20. The antenna device of claim 11, wherein the two antennas are both planar monopole antennas.

* * * * *